US007826779B2

(12) United States Patent
Mase et al.

(10) Patent No.: US 7,826,779 B2
(45) Date of Patent: Nov. 2, 2010

(54) DEVELOPER CARTRIDGE

(75) Inventors: Soichiro Mase, Handa (JP); Hideaki Deguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 434 days.

(21) Appl. No.: 12/046,578

(22) Filed: Mar. 12, 2008

(65) Prior Publication Data

US 2008/0226341 A1 Sep. 18, 2008

(30) Foreign Application Priority Data

Mar. 12, 2007 (JP) ..... 2007-061982

(51) Int. Cl.
*G03G 15/08* (2006.01)
*G03G 21/18* (2006.01)

(52) U.S. Cl. ..... 399/262; 399/25; 399/111; 399/114

(58) Field of Classification Search ..... 399/13, 399/25, 110, 111, 114, 262, 263
See application file for complete search history.

(56) References Cited

U.S. PATENT DOCUMENTS 4,913,087 A * 4/1990 Saita et al. ..... 399/12
6,654,567 B2 * 11/2003 Karakama et al. ..... 399/25
6,892,036 B2 * 5/2005 Ito ..... 399/27
7,447,469 B2 * 11/2008 Uchiyama et al. ..... 399/262
7,616,905 B2 * 11/2009 Masubuchi ..... 399/12

FOREIGN PATENT DOCUMENTS

JP 2002365897 A * 12/2002
JP 2006-221010 8/2006
JP 2006251402 A * 9/2006
JP 2007047399 A * 2/2007
JP 2008009162 A * 1/2008

OTHER PUBLICATIONS

Corresponding Application U.S. Appl. No. 12/046,843, filed Mar. 12, 2008.

* cited by examiner

*Primary Examiner*—David M Gray
*Assistant Examiner*—Fred Braun
(74) *Attorney, Agent, or Firm*—Banner & Witcoff, Ltd.

(57) ABSTRACT

A developer cartridge has: a first body having an opening; a memory unit that has a contact terminal, the memory unit is provided at the first body; and a second body that covers the first body, the second body having a exposure hole; wherein the second body and the first body are movable relative to each other, the second body is able to open and close the opening by a relative movement with regard to the first body, and wherein the contact terminal of the memory faces to outside of the developer cartridge through the exposure hole when the second body is positioned at a first position in which the opening is opened, and the contact terminal of the memory unit is covered with the second body when the second body is positioned at a second position and the opening is closed by the second body.

7 Claims, 9 Drawing Sheets

DEVELOPER CARTRIDGE

CROSS REFERENCE TO RELATED APPLICATION

The present application claims priority from Japanese Patent Application No. 2007-061982, which was filed on Mar. 12, 2007, the disclosure of which is herein incorporated by reference in its entirety.

TECHNICAL FIELD

The present invention relates to a developer cartridge having a memory chip.

BACKGROUND

In general, an image forming apparatus such as a laser printer includes a main body, a process cartridge having a developing roller, and a developer cartridge containing a toner. In the image forming apparatus, the developer cartridge can be attached to and detached from the process cartridge and the process cartridge can be attached to and detached from the main body of the apparatus.

A memory chip that stores a variety of information relating to the developer cartridge is disposed in the developer cartridge. When the developer cartridge is attached to the image forming apparatus through the process cartridge, the memory chip is electrically connected to a terminal disposed in the image forming apparatus body directly or through a conductive portion disposed in the process cartridge. In this way, the image forming apparatus acquires the variety of information stored in the memory chip.

As such a technology, a structure is known in which a panel-like cover covering a contact terminal of a memory chip is rotatably disposed in a developer cartridge (see Patent Document 1). When the developer cartridge is attached to a process cartridge, an end of the cover comes in contact with a part of the process cartridge and the other end of the cover pivots, whereby the contact terminal of the memory chip is exposed and is thus connected to a contact terminal of the process cartridge. According to this structure, since the contact terminal of the memory chip is covered with the cover in a state where the developer cartridge is not attached to the process cartridge, it is possible to prevent contamination or damage of the memory chip.

[Patent Document 1] Japanese Unexamined Patent Application Publication No. 2006-221010

SUMMARY

However, the above-described apparatus disclosed in Patent Document 1 has a following problem. Since a cover should be independent of existing parts (for example, a shutter for opening and closing a toner supply port) in the developer cartridge, there is a problem that the cartridge is complicated.

An object of the invention is to provide a developer cartridge which can suppress contamination or damage of a memory chip (memory unit) and which can simplify a configuration thereof.

In order to accomplish the above-mentioned object, there is provided a developer cartridge that can be attached to and detached from an image forming apparatus and contains a developer, the developer cartridge comprising: a first body that has an opening for supplying the developer; a memory unit that has a contact terminal, the memory unit is provided at the first body; and a second body that covers the first body, the second body having a exposure hole in which the memory unit can face to outside of the developer cartridge; wherein the second body and the first body are movable relative to each other, the second body is able to open and close the opening by a relative movement with regard to the first body, and wherein the contact terminal of the memory faces to outside of the developer cartridge through the exposure hole when the second body is positioned at a first position in which the opening is opened, and the contact terminal of the memory unit is covered with the second body when the second body is positioned at a second position different from the first position and the opening is closed by the second body.

According to a first aspect of the invention, when the opening is closed, the contact terminal of the memory unit is covered with the second body, thereby preventing the contamination or damage thereof. When the opening is opened, the contact terminal of the memory unit is exposed and thus can be connected to a contact terminal disposed at an image forming apparatus. That is, the second body serves as a shutter for opening and closing the opening of the first body as a developer supply port and also serves as a cover for protecting the memory unit. Accordingly, since a cover for protecting the memory unit need not be provided independent of the shutter for opening and closing the developer supply port, it is possible to simplify the device configuration.

According to the present invention, since the memory unit is protected by the second body serving as a shutter for opening and closing the opening of the first body, it is possible to prevent the contamination or damage of the memory unit and to simplify the device configuration.

BRIEF DESCRIPTION OF THE DRAWINGS

Illustrative aspects of the invention will be described in detail with reference to the following figures wherein:

FIG. 9A is a perspective view illustrating a state before the toner cartridge is fitted to the developing cartridge and FIG. 9B is a perspective view illustrating a state after the toner cartridge is fitted to the developing cartridge.

DETAILED DESCRIPTION OF THE PREFERRED EMBODIMENTS

Figure 1:
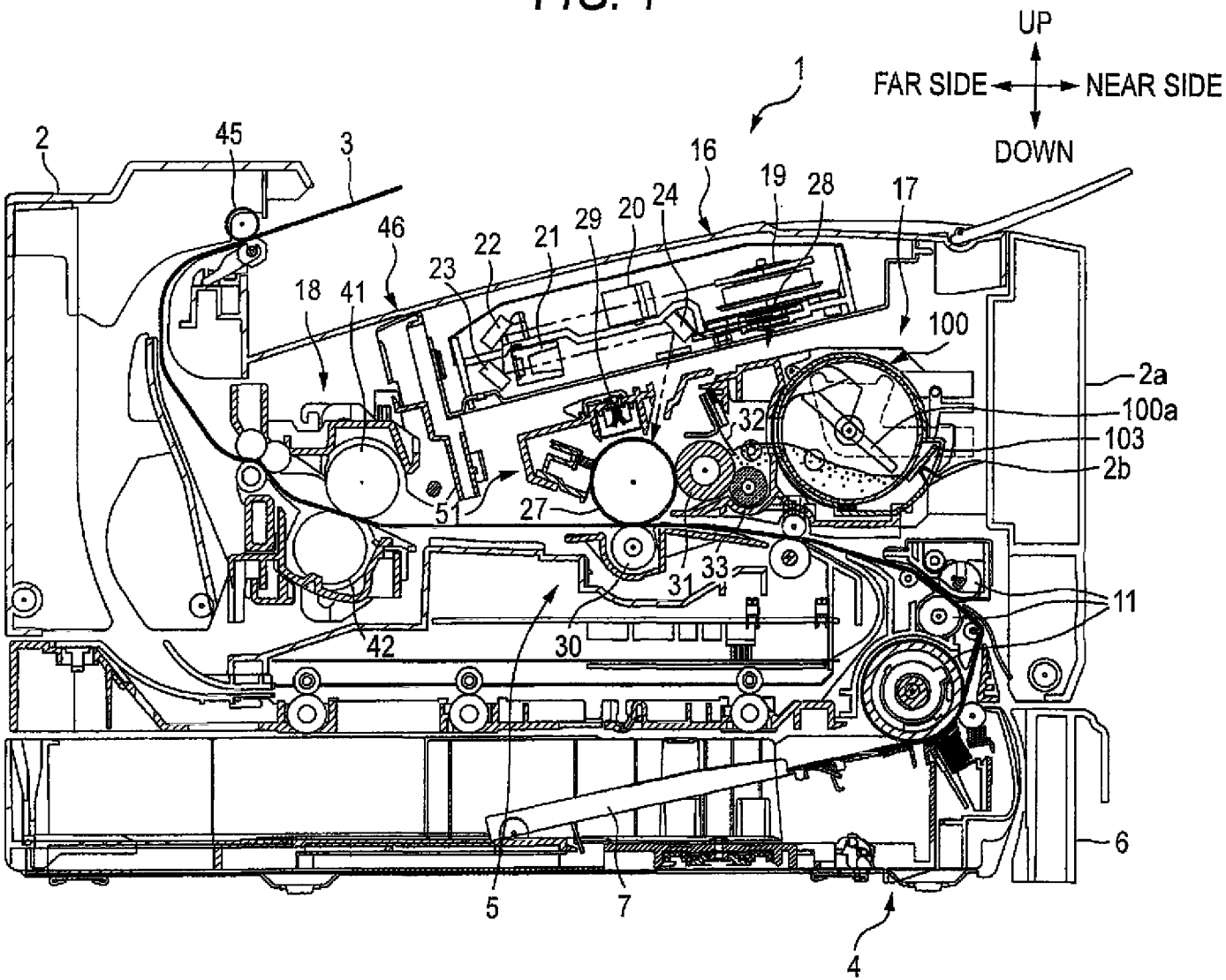
FIG. 1 is a side sectional view illustrating a laser printer according to an exemplary embodiment of the invention.

Hereinafter, an exemplary embodiment of the invention will be described in detail with reference to the attached drawings. FIG. 1 is a side sectional view illustrating a laser printer according to an exemplary embodiment of the invention. In the following description, the entire configuration of a laser printer is first explained in brief and then detailed features of the invention will be explained. In the following description, directions are based on a user using a laser printer 1. That is, in FIG. 1, the right side is defined as a "near side", the left side is defined as a "far side", the far side in the direction perpendicular to the sheet surface is defined as a "right side", and the near side in the direction perpendicular to the surface or the fig sheet is defined as a "left side." Since the vertical direction shown in the figures is equal to the vertical direction at the time when the user uses the apparatus, the vertical direction is defined as a "vertical direction."

<Entire Configuration of Laser Printer>

As shown in FIG. 1, a laser printer 1 as an example of the image forming apparatus includes a feeder unit 4 that feeds a sheet 3 into a main casing 2 as an example of a main body of the apparatus and an image forming unit 5 that forms an image on the fed sheet 3.

<Configuration of Feeder Unit>

The feeder unit 4 includes a sheet feeding tray 6 that is detachably attached to the bottom of the main casing 2 and a sheet pressing plate 7 that is disposed in the sheet feeding tray 6. The feeder unit 4 further includes various rollers 11 that conveys the sheet 3 or removes sheet powders.

In the feeder unit 4 having the above-mentioned configuration, the sheet 3 in the sheet feeding tray 6 is sent to the upper side of the sheet pressing plate 7 and is conveyed to the image forming unit 5 by the various rollers 11.

<Configuration of Image Forming Unit>

The image forming unit 5 includes a scanner unit 16, a process cartridge 17, and a fixing unit 18.

<Configuration of Scanner Unit>

The scanner unit 16 is disposed in the upper portion of the main casing 2 and includes a laser-emitting portion (not shown), a polygon mirror 19 that is rotationally driven, lenses 20 and 21, and reflecting mirrors 22, 23, and 24. A laser beam based on image data and emitted from the laser-emitting portion is transmitted or reflected by the polygon mirror 19, the lens 20, the reflecting mirror 22, the reflecting mirror 23, the lens 21, and the reflecting mirror 24 in this order as indicated by a dotted line and then is applied to the surface of a photosensitive drum 27 of the process cartridge 17 at a high speed.

<Configuration of Process Cartridge>

The process cartridge 17 is detachably attached to the main casing 2 when a front cover 2*a*, which is disposed in the front of the main casing 2, opens. The process cartridge 17 includes a developing cartridge 28 and a drum unit 51.

The developing cartridge 28 can be attached to and detached from the main casing 2 in a state where it is fitted to the drum unit 51. The developing cartridge 28 may be freely attached to and detached from the drum unit 51 fixed to the main casing 2.

The developing cartridge 28 includes a toner cartridge 100 that can be attached to and detached from the developing cartridge, a developing roller 31, a thickness regulating blade 32, and a supply roller 33. A toner in the toner cartridge 100 is agitated by an agitator 100*a* and is then supplied to the developing roller 31 by the supply roller 33. At this time, the toner is frictionally charged positive between the supply roller 33 and the developing roller 31. The toner supplied to the developing roller 31 enters between the thickness regulating blade 32 and the developing roller 31 and is held as a thin layer having a constant thickness on the developing roller 31, with the rotation of the developing roller 31.

The drum unit 51 includes a photosensitive drum 27, a scorotron charging unit 29, and a transfer roller 30.

The photosensitive drum 27 is rotatably supported in the body of the drum unit 51.

The scorotron charging unit 29 is a positive scorotron charging unit for generating a corona discharge from a charging wire made of tungsten or the like and serves to charge the surface of the photosensitive drum 27 to be uniformly positive.

The transfer roller 30 is disposed below the photosensitive drum 27 so as to come in opposed contact with the photosensitive drum 27. And the transfer roller 30 is rotatably supported in the body of the drum unit 51. A transfer bias is applied to the transfer roller 30 based on the static current control at the time of transfer.

The surface of the photosensitive drum 27 is uniformly charged positive by the scorotron charging unit 29 and then is exposed to a laser beam from the scanner unit 16 at a high speed. Accordingly, the potential of the exposed portion is lowered to form an electrostatic latent image based on image data. Here, the "electrostatic latent image" means an exposed portion which is exposed to the laser beam and is lowered in potential on the surface of the photosensitive drum 27 uniformly charged positive. And, with the rotation of the developing roller 31, the toner held on the developing roller 31 is supplied to the electrostatic latent image formed on the surface of the photosensitive drum 27 at the time of coming in contact with the photosensitive drum 27. The toner is selectively held on the surface of the photosensitive drum 27 and is visualized, thereby forming a toner image by an inversion phenomenon.

Thereafter, the photosensitive drum 27 and the transfer roller 30 are rotationally driven to convey a sheet 3 therebetween. By conveying the sheet 3 between the photosensitive drum 27 and the transfer roller 30, the toner image held on the surface of the photosensitive drum 27 is transferred to the sheet 3.

<Configuration of Fixing Unit>

The Fixing unit 18 is disposed on the downstream side of the process cartridge 17 and includes a heating roller 41 and a pressing roller 42 that is opposed to the heating roller 41 so as to press the heating roller 41. The fixing unit 18 thermally fixes the toner transferred to the sheet 3 while the sheet 3 passes between the heating roller 41 and the pressing roller 42. The sheet 3 thermally fixed by the fixing unit 18 is conveyed to the discharge roller 45 disposed on the downstream side of the fixing unit 18 and is sent to a sheet discharging tray 46 by the discharge roller 45.

<Detailed Structure of Toner Cartridge>

Figure 2:
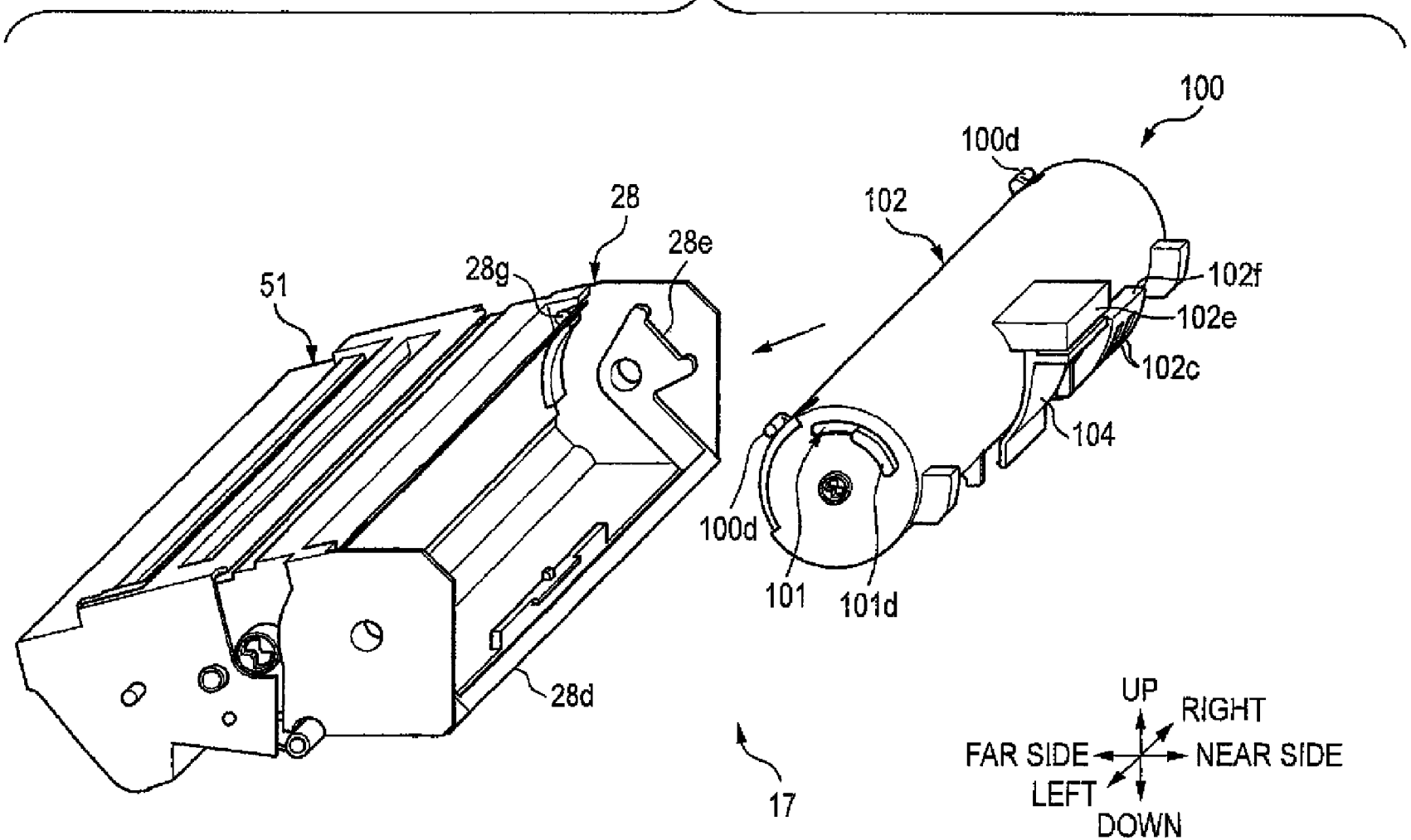
FIG. 2 is an exploded perspective view illustrating a developing cartridge and a toner cartridge.
Figure 3:
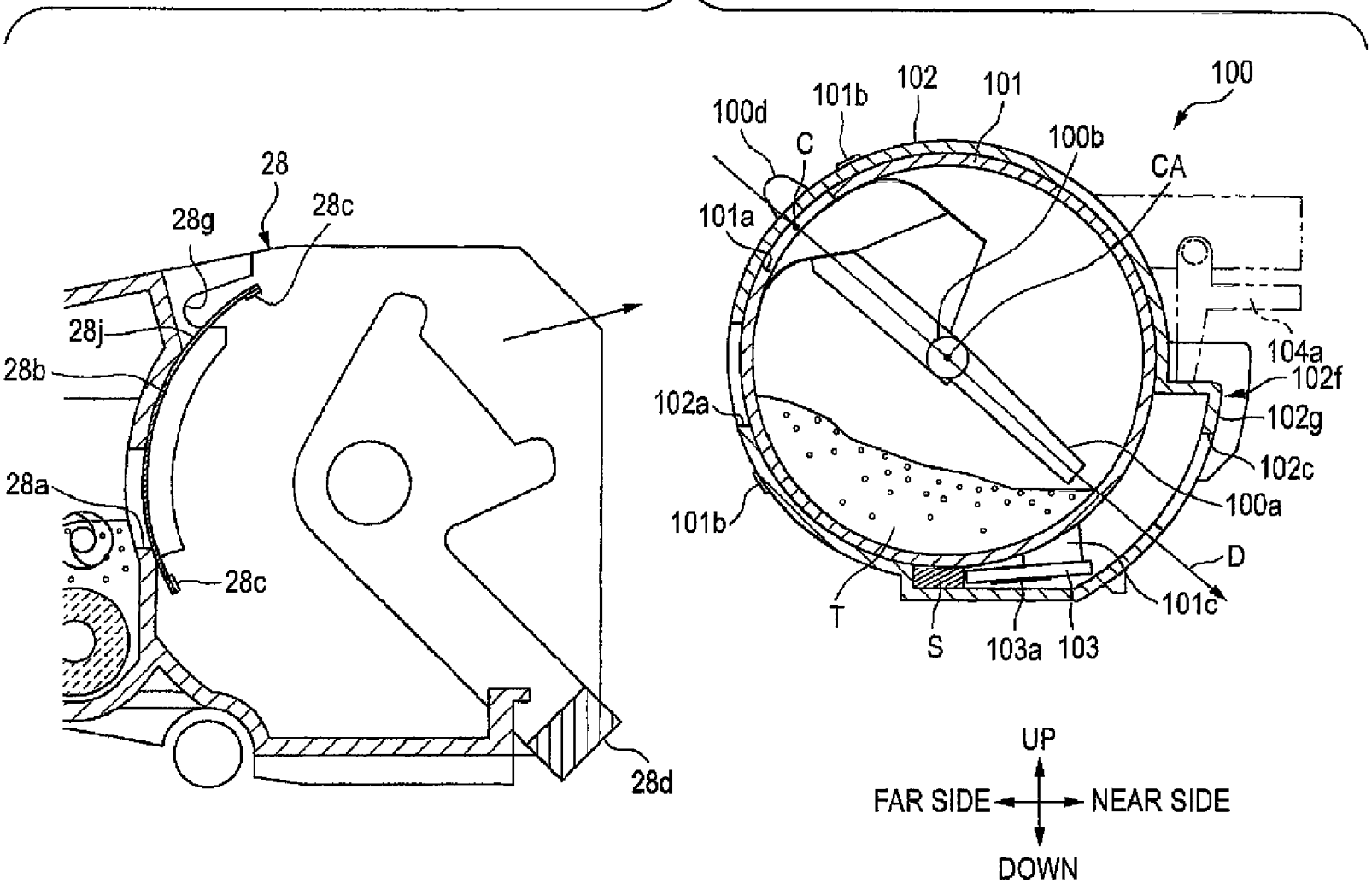
FIG. 3 is a cross-sectional view illustrating the developing cartridge and the toner cartridge.
Figure 4A:
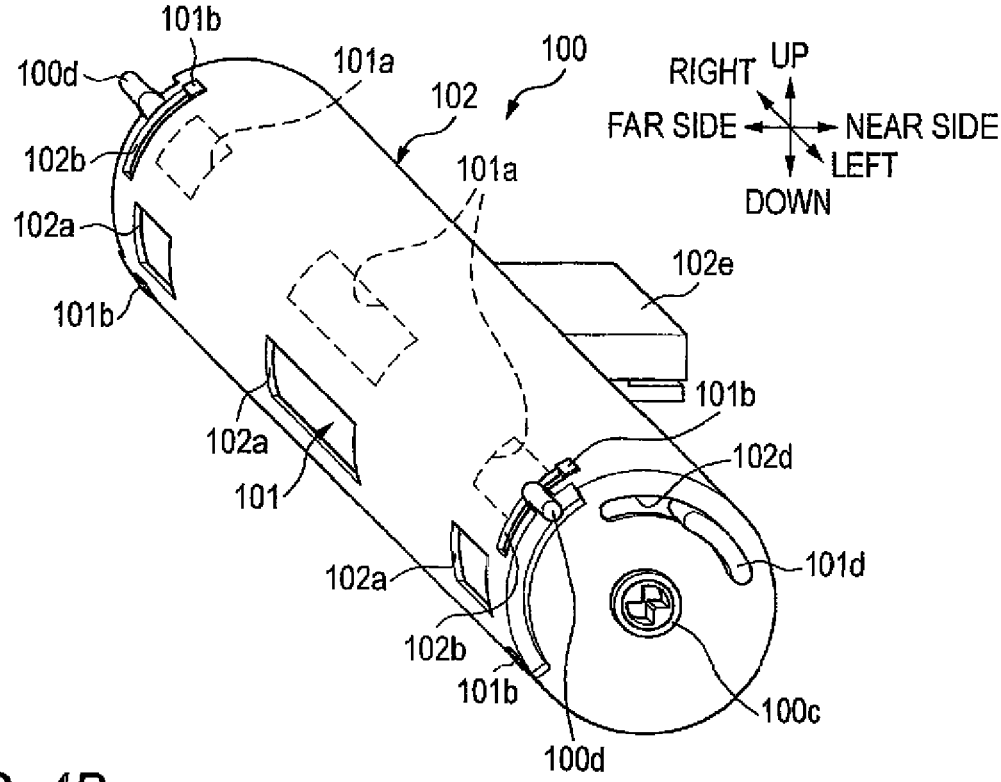
FIG. 4A is a perspective view illustrating the toner cartridge when an inner opening and an outer opening are closed and FIG. 4B is a perspective view illustrating the toner cartridge when the inner opening and the outer opening communicate with each other.
Figure 4B:
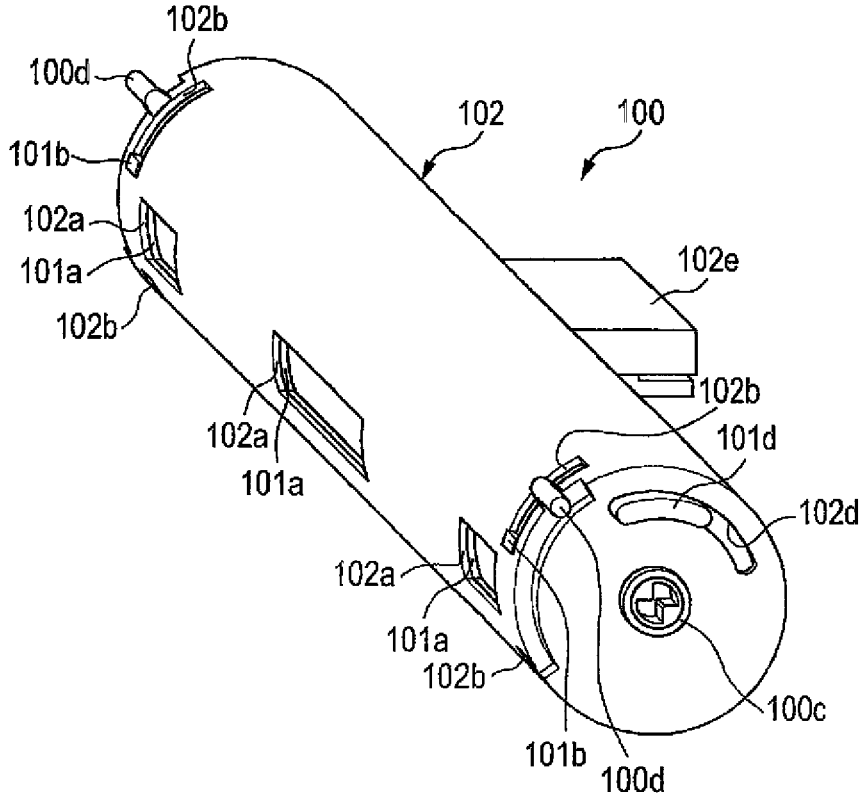
Figure 5:
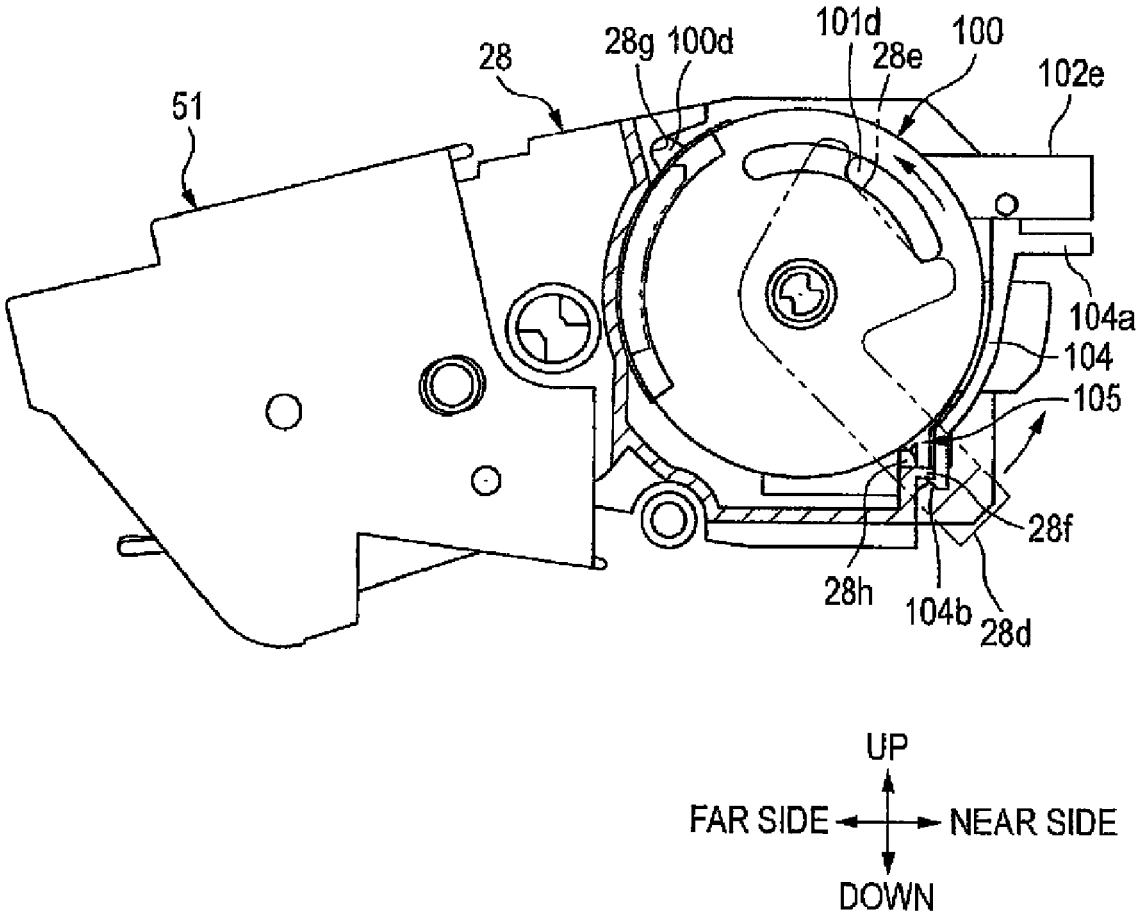
FIG. 5 is a side view illustrating a relation between an arc-shaped protrusion and an operation lever.
Figure 6A:
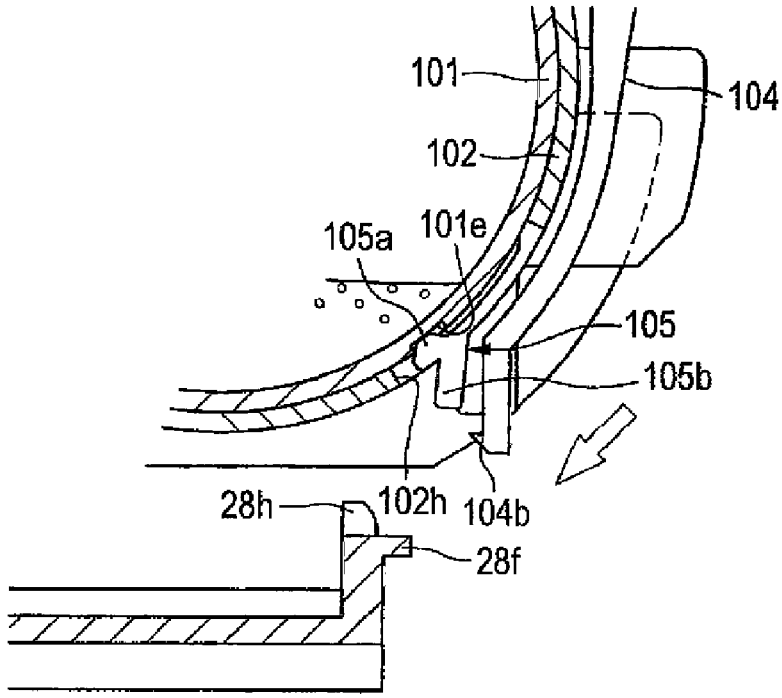
FIG. 6A is an enlarged sectional view illustrating a fixing lever and a locking member before the toner cartridge is fitted to the developing cartridge.
Figure 7:
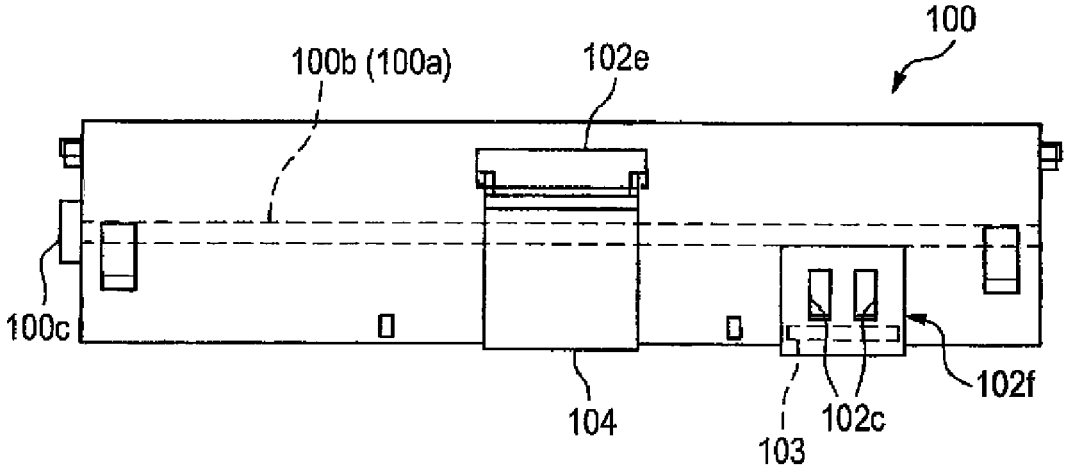
FIG. 7 is a front view of the toner cartridge.
Figure 8A:
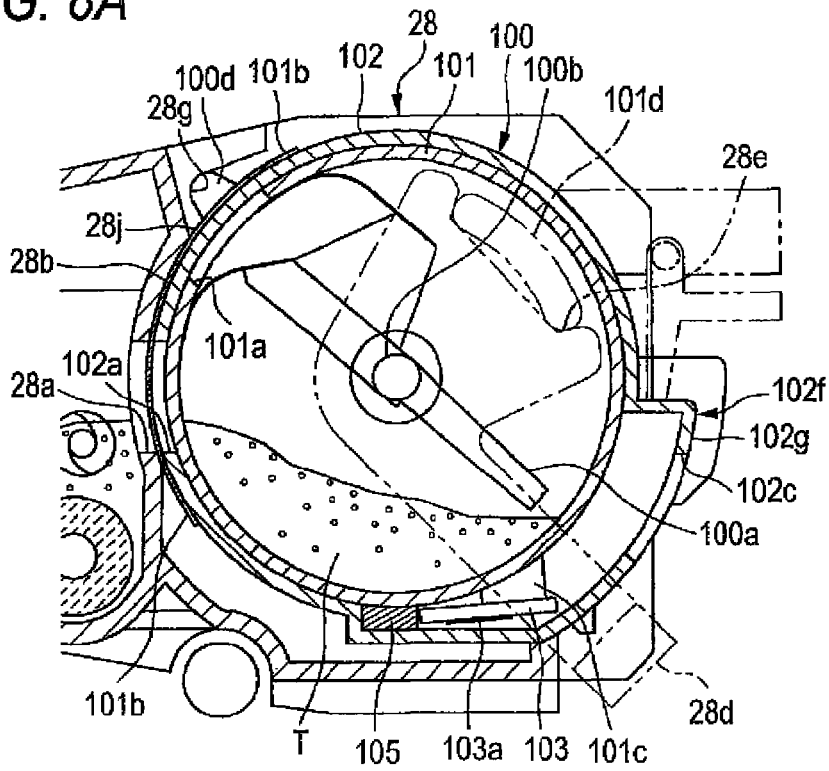
FIG. 8A is a cross-sectional view illustrating a state where a memory chip is covered with an outer body.
Figure 8B:
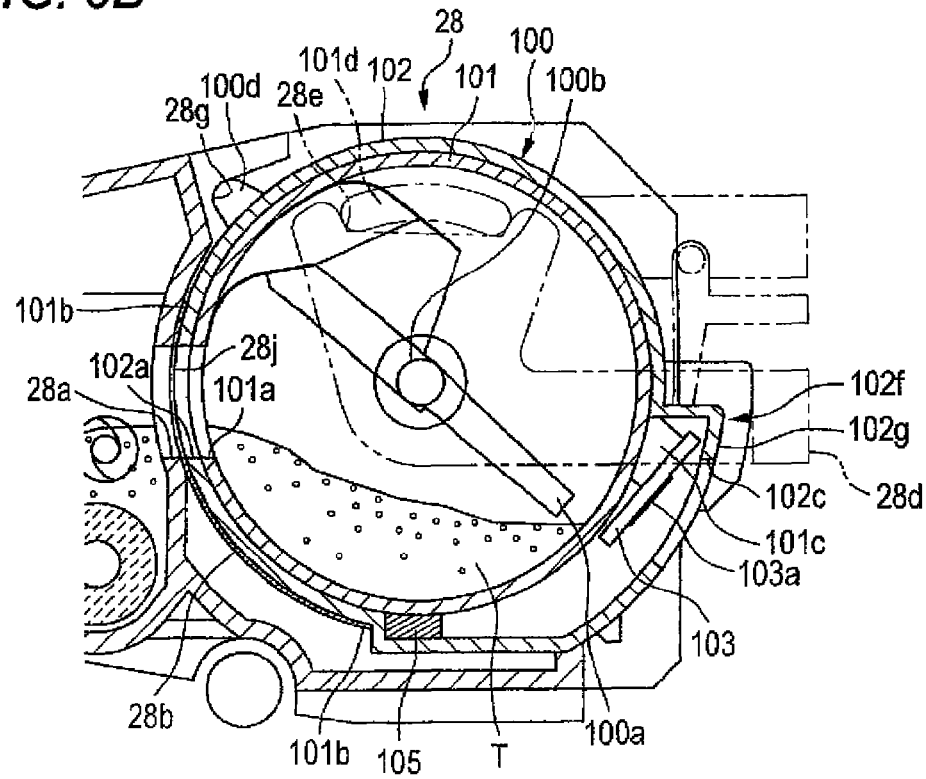
FIG. 8B is a cross-sectional view illustrating a state where the memory chip is exposed from an exposure hole.

Next, the detailed structure of a toner cartridge 100 as an example of the developer cartridge according to the invention will be described. In the drawings, FIG. 2 is an exploded perspective view illustrating the developing cartridge and the toner cartridge and FIG. 3 is a sectional view illustrating the developing cartridge and the toner cartridge. FIG. 4A is a perspective view illustrating the toner cartridge when an inner opening and an outer opening are closed and FIG. 4B is a perspective view illustrating the toner cartridge when the inner opening and the outer opening communicate with each other. FIG. 5 is a side view illustrating a relation between an arc-shaped protrusion and an operation lever. FIG. 6A is an enlarged sectional view illustrating a fixing lever and a locking member before the toner cartridge is fitted to the developing cartridge and FIG. 8B is an enlarged sectional view illustrating the fixing lever and the locking member after the toner cartridge is fitted to the developing cartridge. FIG. 7 is a front view of the toner cartridge. FIG. 8A is a cross-sectional view illustrating a state where a memory chip is covered with an outer body and FIG. 8B is a cross-sectional view illustrating a state where the memory chip is exposed from an exposure hole.

As shown in FIG. 2, the toner cartridge 100 constitutes a process cartridge 17 along with the developing cartridge 28 and the drum unit 51 and is detachably attached to the main casing 2 in a state where it is attached to the developing cartridge 28. Specifically, as shown in FIG. 3, the toner cartridge 100 includes an inner body 101 that contains a toner T, an outer body 102 that is movable relative to the inner body 101, and a memory chip 103 as an example of memory means fixed to the outer circumferential surface of the inner body 101. Here, the memory chip 103 stores a variety of information such as an amount of toner contained in the toner cartridge 100. The variety of information is read by a reading device disposed in the main casing 2 and is used to perform various control operations for the laser printer 1.

The inner body 101 is formed in a hollow cylinder shape and is rotatably supported by a cylindrical inner circumferential surface of the outer body 102. An inner opening 101*a* for supplying the toner T to the developing cartridge 28 is formed at a far position on a cylindrical outer circumferential surface of the inner body 101. As shown in FIG. 4B, three inner openings 101*a* are disposed with a predetermined gap in the axis direction of the inner body 101 and the inner opening 101*a* located at the center thereof is longer in the axis direction than the inner openings 101*a* located at both sides.

A pair of shutter engaging protrusions 101*b* protruding externally in the diameter direction is formed at one end and the other end of the outer circumferential surface of the inner body 101. As shown in FIG. 3, the shutter engaging protrusions 101*b* engage with engaging portions 28*c* so as to interpose a pair of engaging portions 28*c*, which is formed in a shutter 28*b* for opening and closing a toner supply hole 28*a* of the developing cartridge 28, therebetween in the rotation direction when the toner cartridge 100 is attached to the developing cartridge 28.

A seat portion 101*c* for fixing the memory chip 103 is formed at a front-lower position on the cylindrical outer circumferential surface of the inner body 101. That is, the memory chip 103 fixed to the seat portion 101*c* is disposed to be opposite to the inner opening 101*a* with a center axis CA of the inner body 101 interposed therebetween in a direction D connecting the center C of the inner opening 101*a* and the center axis CA of the inner body 101 among the diameter directions of the inner body 101. The seat portion 101*a* is formed at the same position in the axis direction (width direction) of the inner body 101 as an exposure hole 102*c* (see FIG. 2) formed in the outer body 102.

As shown in FIG. 2, arc-shaped protrusions 101*d* (only one is shown) protruding externally in the axis direction are formed at both ends of the inner body 101. The arc-shaped protrusions 101*d* are inserted into concave portions 28*e* of an operation lever 28*d* disposed pivotally in the developing cartridge 28 when the toner cartridge 100 is attached to the developing cartridge 28. Accordingly, as shown in FIG. 5, by allowing the operation lever 28*d* engaging with the arc-shaped protrusions 101*d* to pivot in the circumferential direction, the inner body 101 rotates relative to the outer body 102.

The outer body 102 is formed in a hollow cylinder shape and outer openings 102*a* that can communicate with the inner openings 101*a* of the inner body 101 are formed in far positions on a cylindrical outer circumferential wall, as shown in FIG. 3. As shown in FIG. 4B, three outer openings 102*a* are disposed in parallel in the axis direction to correspond to three inner openings 101*a* disposed in parallel in the axis direction.

A pair of longitudinal grooves 102*b* engaging with the pair of shutter engaging protrusions 101*b* formed at both ends of the inner body 101 to be slidable in the circumferential direction is formed at both ends on the outer circumferential wall of the outer body 102. Arc shaped longitudinal grooves 102*d* (only one is shown) engaging with the arc-shaped protrusions 101*d* of the inner body 101 so as to be slidable in the circumferential direction are formed at both ends of the outer body 102. Since the longitudinal grooves 102*b* and the arc-shaped longitudinal grooves 102*d* are formed with a predetermined length, the inner body 101 is rotatable relative to the outer body 102 by the predetermined length.

A drive delivery portion 100*c*, which is fixed to the left end of the rotation shaft 100*b* of the agitator 100*a* disposed to be rotatable relative to the inner body 101 and the outer body 102, is disposed on the left end surface of the outer body 102. When power is delivered to the drive delivery portion 100*c* from the main casing 2, the agitator 100*a* rotates.

As shown in FIG. 2, a grip portion 102*e*, a fixing lever 104, and a memory receiving room 102*f* are disposed on the front side of the outer circumferential surface of the outer body 102. The grip portion 102*e* is a portion gripped by a user and protrudes forward from the center in the axis direction of the outer body 102.

As shown in FIG. 5, the fixing lever 104 is disposed below the grip portion 102*e* and the upper end thereof is rotatably supported by the grip portion 102*e*, whereby the lower end of the fixing lever 104 can pivot forward and backward. An operation piece 104*a* extending to the front along the grip portion 102*e* is formed in the upper end of the fixing lever 104. An engaging claw 104*b* protruding to the far side is formed at the lower end of the fixing lever 104. The engaging claw 104*b* of the fixing lever 104 is always biased to the far side by a spring. Accordingly, when the toner cartridge 100 is attached to the developing cartridge 28, the engaging claw 104*b* is hooked to an engaging portion 28*f* formed in the developing cartridge 28, whereby the toner cartridge 100 is fixed to the developing cartridge 2S. Specifically, the fixation of the toner cartridge 100 is realized, as shown in FIG. 2, by allowing a positioning pin 100*d* formed in the far-up side of the toner cartridge 100 to engage with a positioning concave portion 28*g* of the developing cartridge 28, as well as by hooking the engaging claw 104*b* to the engaging portion 28*f*.

As shown in FIG. 6A, a locking member 105 that release or locks the relative movement between the inner body 101 and the outer body 102 is disposed inside the lower end of the fixing lever 104. Specifically, an end of the locking member 105 is integrally formed with (or fixed to) the inner edge of a through hole 102*h* formed in the front-down side of the outer body 102 and thus the locking member can warp in the diameter direction of the outer body 102. A locking piece 105*a* protruding inward in the diameter direction of the outer body 102 is formed at the other end of the locking member 105. By allowing the locking piece 105*a* to engage with an engaging concave portion 101*e* formed at a corresponding position of the inner body 101, the relative movement between the inner body 101 and the outer body 102 is locked.

A release piece 105*b* protruding outward (downward) in the diameter direction from the outer circumferential surface of the outer body 102 is formed at the other end of the locking member 105. When the toner cartridge 100 is attached to the developing cartridge 28, the release piece 105*b* comes in contact with a stopper 28*h* formed in the developing cartridge 28 and is pushed outward in the diameter direction of the outer body 102. Accordingly, the locking piece 105*a* is pulled out of the engaging concave portion 101*e* of the inner body 101.

As shown in FIG. 7, the memory receiving room 102*f* is disposed on the right side of the grip portion 102*e*. As shown in FIG. 3, the memory receiving room 102*f* is defined by a swelling wall 102*g* of the outer body 102 swelling to the front side and the lower side and an outer circumferential wall of the inner body 101. The exposure hole 102*c* for exposing externally the memory chip 103 is formed through the front wall of the swelling wall 102*g*. As shown in FIG. 7, since the memory receiving room 102*f* is disposed on the right side of the grip portion 102*e*, the exposure hole 102*c* is disposed at a position deviating in the axis direction of the outer body 102, that is, in the width direction (lateral width direction) of the outer body 102, from the grip portion 102*e*.

The lateral width and the longitudinal width of the exposure hole 102*c* have magnitudes corresponding to the lateral width and the longitudinal width of two wire-shaped terminals 2*b* disposed in the main casing 2 shown in FIG. 1. Here, "magnitudes corresponding to the lateral width and the longitudinal width of two wire-shaped terminals 2*b*" means magnitudes in which clearance of about 2 mm is considered with respect to the lateral width and the longitudinal width of the terminals 2*b*.

As shown in FIG. 3, a sponge-like sealing member $ for suppressing the movement of the toner from the inner opening 101*a* to the memory chip 103 is disposed below the memory receiving room 102*f*, that is, between the lower wall of the swelling wall 102*g* and the inner body 101.

The memory chip 103 is fixed to the seat portion 101*c* of the inner body 101 in a state where the contact 103*a* thereof. Races the outside in the diameter direction of the inner body 101. Accordingly, the contact terminal 103*a* of the memory chip 103 is covered with the outer body 102, as shown in FIG. 8A, when the inner opening 101*a* and the outer opening 102*a* are closed. And, as shown in FIG. 8B, the contact terminal 103*a* is exposed externally from the exposure hole 102*c*, when the inner opening 101*a* and the outer opening 102*a* communicate with each other. As shown in FIG. 7, the memory chip 103 is disposed at the right end of the rotation shaft 100*b*, while the drive delivery portion 100*c* is disposed at the left end of the rotation shaft 100*b* of the agitator 100*a*. Accordingly, vibration of the drive delivery portion 100*c* is hardly transmitted to the memory chip 103.

Next, a method of attaching the toner cartridge 100 to the developing cartridge 28 and a method of attaching the developing cartridge 28 to the main casing 2 will be described.

Figure 6B:
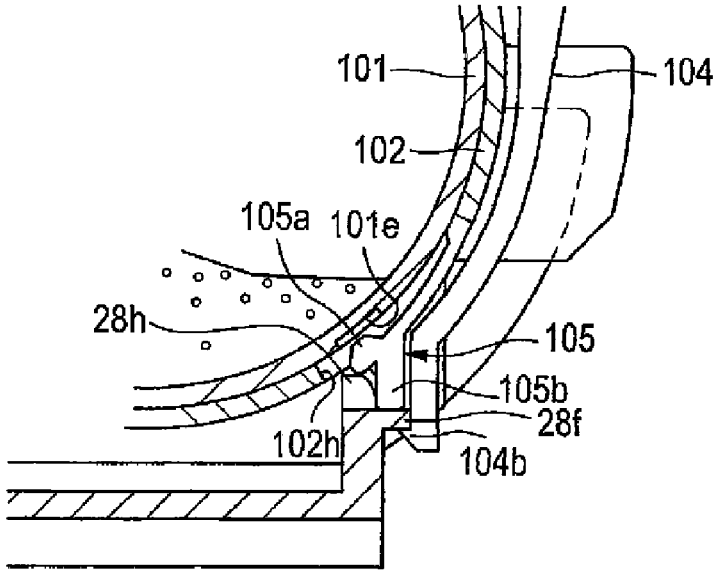
FIG. 6B is an enlarged sectional view illustrating the fixing lever and the locking member after the toner cartridge is fitted to the developing cartridge.

First, as shown in FIG. 3, the toner cartridge 100 is attached to the front portion of the developing cartridge 28 while the positioning pin 100*d* of the toner cartridge 100 is positioned to the positioning concave portion 28*g* of the developing cartridge 28. At this time, as shown in FIG. 6, by hooking the engaging claw 104*b* of the fixing lever 104 to the engaging portion 28*f* of the developing cartridge 28, the toner cartridge 100 is fixed to the developing cartridge 28.

By allowing the release piece 105*b* of the locking member 105 to engage with the stopper 28*h* of the developing cartridge 28, the locking piece 105*a* is pulled out of the engaging concave portion 101*e* of the inner body 101 and thus the inner body 101 can be rotatable relative to the outer body 102. As shown in FIG. 8A, the arc-shaped protrusions 101*d* formed at the ends of the inner body 101 enter the concave portions 28*e* of the operation lever 28*d* of the developing cartridge 28 and the shutter engaging protrusion 101*b* formed in the far upper portion on the outer circumferential surface of the inner body 101 engages with the shutter 28*b* of the developing cartridge 28.

As shown in FIG. 8B, when the operation lever 28*d* of the developing cartridge 28 is made to pivot upward after the toner cartridge 100 is attached to the developing cartridge 28 in the above-mentioned way, the inner body 101 and the shutter 28*b* rotate together relative to the outer body 102. Accordingly, the inner opening 101*a*, the outer opening 102*a*, a shutter opening 28*j*, and the toner supply hole 28*a* communicate with one another and the memory chip 103 is thus exposed externally from the exposure hole 102*c*.

Thereafter, as shown in FIG. 1, the developing cartridge 28 mounted with the toner cartridge 100 is inserted into the main casing 2 and is attached to the drum unit 51 fitted to the main casing 2. At this time, the developing cartridge 28 is guided by a guide portion of the main casing 2 so that it is maintained in a horizontal posture up to a predetermined position and then the front portion thereof goes down after the predetermined position. In this way, the developing cartridge is attached to the main casing 2. When the developing cartridge 28 has been attached, the terminal 2*b* disposed in the main casing 2 enters the toner cartridge 100 through the exposure hole 102*c* (see FIG. 3) and comes in contact with the memory chip 103.

According to the above-mentioned embodiment, the following advantages can be obtained.

Since the memory chip 103 is protected by the outer body 102 serving as a shutter for opening and closing the inner opening 101*a* of the inner body 101, it is possible to suppress the contamination or damage of the memory chip 103 and to further simplify the device configuration.

When the inner opening 101*a* and the outer opening 102*a* are closed, the contact 103*a* of the memory chip 103 is electrically disconnected from the terminal 2*b* of the main casing 2 and thus the laser printer 1 does not work, thereby urging a user to raise the operation lever 28*d*. That is, since the information of the memory chip 103 can be read by the laser printer 1 after the inner opening 101*a* and the outer opening 102*a* have communicated with each other so as to supply the toner from the toner cartridge 100 to the developing cartridge 28, it is possible to suppress an erroneous operation of the laser printer 1.

The memory chip 103 is disposed to be opposite to the inner opening 101*a* with the center axis CA of the inner body 101 in the direction D shown in FIG. 3. Accordingly, even when the toner leaks between the inner body 101 and the outer body 102, the toner hardly reaches the memory chip 103 apart from the inner opening 101*a*, thereby preventing the contamination of the memory chip 103.

Since the sealing member S is disposed between the inner body 101 and the outer body 102, it is possible to further prevent the contamination of the memory chip 103 due to the toner.

The exposure hole 102*c* is disposed at a position deviating in the axis direction of the outer body 102 from the grip portion 102*e*. Accordingly, even when the exposure hole 102*c* is greater than a user's finger, the user's finger is prevented from coming in contact with the memory chip 103 at the time of the user gripping the grip portion 102*e*, thereby preventing the contamination of the memory chip 103.

Since the locking member 105 for releasing or locking the relative rotation between the inner body 101 and the outer body 102 is disposed, the leakage of a toner is prevented due to the communication of the inner opening 101*a* and the outer opening portion 102*a* with each other in the toner cartridge 100 in a single product state.

Since the drive delivery portion 100*c* is disposed at the left end of the rotation shaft 100*b* of the agitator 100*a* and the memory chip 103 is disposed at the right end of the rotation shaft 100*b*, the vibration of the drive delivery portion 100*c* is hardly transmitted to the memory chip 103, thereby elongating the lifetime of the memory chip 103.

Since the width of the exposure hole 102*c* corresponds to the width of the terminal 2*b* which is generally smaller than a human finger, the user's finger does not come in contact with the contact 103*a* of the memory chip 103 through the exposure hole 102*c*, thereby preventing the contamination of the memory chip 103.

The invention is not limited to the above-mentioned embodiment, but may be modified in various forms as described below.

Although it has been described in the embodiment that the toner cartridge 100 is attached to the main casing 2 in a state where the developing cartridge 28 and the drum unit 51 is incorporated into a bundle, the invention is not limited to the configuration. For example, when the parts of the developing cartridge 28 are fixed to the main casing 2, the toner cartridge 100 may be attached directly to the main casing 2.

Although it has been described in the embodiment that the developing cartridge 28 can be freely attached to and detached from the drum unit 51, the developing cartridge 28 and the drum unit 51 may be formed in a bundle (not detachable).

Figure 9A:
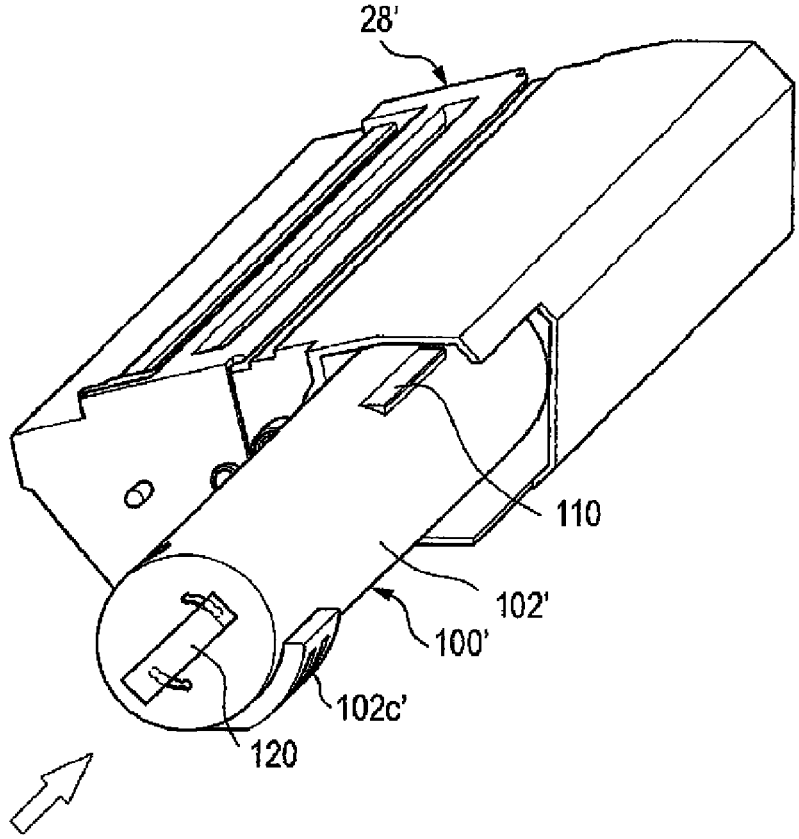
FIG. 9A and FIG. 9B are perspective views illustrating a toner cartridge and a developing cartridge according to another exemplary embodiment of the invention, where
Figure 9B:
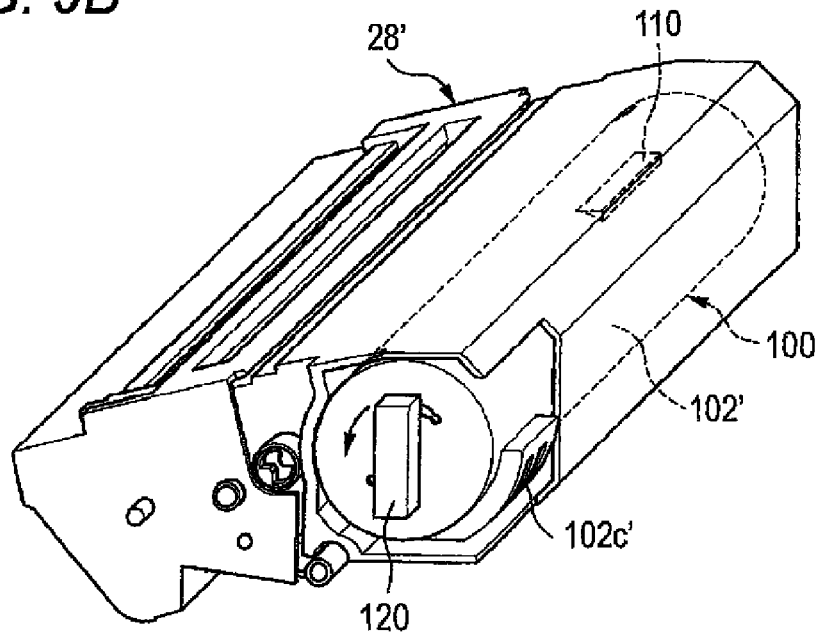

Although it has been described in the embodiment that the attachment direction of the toner cartridge 100 is set to the diameter thereof, the invention is not limited to it. For example, as shown in FIGS. 9A and 9B, the attachment direction of a toner cartridge 100' may be set to the axis direction. In this case, a memory chip may be covered with an outer body 102' or may be exposed from an exposure hole 102*c'* of the outer body 102'. In this case, the grip portion 102*e* and the fixing lever 104 provided in the embodiment are not necessary. In the toner cartridge 100', only by disposing a locking piece 110 locked to a part of a developing cartridge 28' on a part of the outer circumferential surface of the cylinder shape thereof, the outer body 102' can be made not to be movable relative to the developing cartridge 28' In this case, an operating portion 120 for allowing an inner body to rotate relative to the outer body 102' is disposed in an end surface of the outer body 102'. Accordingly, the structure for rotating the inner body can be more simplified than the above-mentioned embodiment, thereby reducing the manufacturing cost.

Although it has been described in the embodiment that the inner body 101 and the outer body 102 are formed in a hollow cylinder shape and the inner body 101 rotates relative to the outer body 102, the invention is not limited to it. For example, the inner body and the outer body may be both in a hollow rectangular shape and the inner body and the outer body may be made to move relative to each other along a predetermined side thereof.

Although it has been described in the above-mentioned embodiment that the inner body 101 is made to rotate relative to the outer body 102 fixed to the developing cartridge 28, the invention is not limited to it. On the contrary, the inner body 101 may be fixed to the developing cartridge 28 and the outer body 102 may be made to rotate relative to the inner body 101.

Although the invention has been applied to the laser printer 1 in the above-mentioned embodiment, the invention is not limited to it, but the invention may be applied to other image forming apparatus such as copiers or multi-function device.

Although it has been described in the above-mentioned embodiment that the toner cartridge 100 contains a positively-charging developer, the toner cartridge may contain a negatively-charging developer.

What is claimed is:

1. A developer cartridge that can be attached to and detached from an image forming apparatus and contains a developer, the developer cartridge comprising:

a first body that has an opening for supplying the developer;

a memory unit that has a contact terminal, the memory unit is provided at the first body; and a second body that covers the first body, the second body having a exposure hole in which the memory unit can face to outside of the developer cartridge;

wherein the second body and the first body are movable relative to each other, the second body is able to open and close the opening by a relative movement with regard to the first body, and wherein the contact terminal of the memory faces to outside of the developer cartridge through the exposure hole when the second body is positioned at a first position in which the opening is opened, and the contact terminal of the memory unit is covered with the second body when the second body is positioned at a second position different from the first position and the opening is closed by the second body.

2. The developer cartridge according to claim 1, wherein the first body is formed in a hollow cylinder shape, and wherein the memory unit is provided at a mounting position opposite to the opening through the center axis of the first body interposed between the mounting position and the opening in a direction in which the center of the opening is connected to the center axis of the first body among diameter directions of the first body.

3. The developer cartridge according to claim 1, the developer cartridge further comprising:

a sealing member suppressing that the developer moves to the memory unit from the opening, the sealing member is disposed between the first body and the second body.

4. The developer cartridge according to claim 1, wherein a grip portion gripped by a user is disposed on the second body, and wherein the exposure hole is disposed at a position deviating in a width direction of the second body from the grip portion.

5. The developer cartridge according to claim 1, the developer cartridge further comprising:

a locking member that releases and locks a relative movement between the first body and the second body.

6. The developer cartridge according to claim 1, the developer cartridge further comprising:

an agitator that agitates the developer; and a drive delivery member disposed close one end of the agitator;

wherein the agitator and the drive delivery member are disposed to be rotatable with respect to the first body and the second body, and wherein the memory unit is disposed close to the other end of the agitator.

7. The developer cartridge according to claim 1, wherein the exposure hole has a size corresponding to the width of a contact terminal of an image forming apparatus electrically connected to the contact terminal of the memory unit.

* * * * *